US007665179B2

(12) United States Patent
Connolly

(10) Patent No.: US 7,665,179 B2
(45) Date of Patent: Feb. 23, 2010

(54) ADJUSTABLE WIRE ROPE CLEANING DEVICE

(76) Inventor: Michael J Connolly, 60-17 54th Ave., Maspeth, NY (US) 11378

( * ) Notice: Subject to any disclaimer, the term of this patent is extended or adjusted under 35 U.S.C. 154(b) by 871 days.

(21) Appl. No.: 11/209,601

(22) Filed: Aug. 23, 2005

(65) Prior Publication Data

US 2007/0044267 A1 Mar. 1, 2007

(51) Int. Cl.
*B08B 11/00* (2006.01)
*B66B 7/12* (2006.01)

(52) U.S. Cl. ..... 15/256.6; 15/88

(58) Field of Classification Search ..... 15/159.1, 15/172, 246, 256.6, 88
See application file for complete search history.

(56) References Cited

U.S. PATENT DOCUMENTS 5,784,752 A * 7/1998 Barrett et al. ..... 15/256.6
6,470,528 B1 * 10/2002 Connolly ..... 15/256.6
7,412,745 B2 * 8/2008 Connolly ..... 15/256.6

* cited by examiner

*Primary Examiner*—Randall Chin
(74) *Attorney, Agent, or Firm*—Ostrolenk Faber LLP

(57) ABSTRACT

An adjustable wire rope cleaning device comprising a first base plate and a second base plate, each having opposite ends and two longitudinal sides. Side bars are at the longitudinal sides of at least one of the first base plate and the second base plate and are aligned along an axis of the first base plate, such that a guide channel is defined and partially enclosed by the side bars. The second base plate is slidably attached to the first base plate and within the guide channel. A lateral bar at one end of the first base plate and between the two side bars, and the lateral bar is transverse to the side bars. An adjustment device positioned between the lateral bar and the second base plate, the adjustment device is operable to move the second base plate relative to the first base plate along the axis defined by the guide channel. A brush is coupled to the second base plate, and the brush is adjusted by movement of the second base plate within the guide channel.

17 Claims, 12 Drawing Sheets

ADJUSTABLE WIRE ROPE CLEANING DEVICE

BACKGROUND OF THE INVENTION

1. Field of the Invention

The present invention relates to a device for cleaning wire rope, such as those used in the elevator industry.

2. Description of the Related Art

The conventional manner of operating elevators is by raising and lowering a typically enclosed platform, the elevator using an electronically controlled, variable speed hoisting machine. The platform is connected to cabling which moves by the hoisting machine. The cabling is typically comprised of a plurality (e.g., five or six) of steel ropes. Each of the steel ropes is typically fabricated from multiple strands, and each strand contains multiple individual wires that are spirally wrapped around a fiber core to form lengths of cylindrical traction steel. The size or diameter of the rope used on each elevator is, typically, determined by engineering specifications regarding load capacity, elevator speed and vertical height.

Drawing FIG. 1 hereof is an elementary representation of a conventional elevator installation 10. A plurality of separate ropes 100 extend from the top of the elevator car 110, over the hoisting machine 130 and the deflector sheave 120, to the top of the counterweight 140. The deflector sheave 120 is positioned laterally away from the elevator car 110 to offset the car from the counterweight 140, so that each will not interfere with the vertical travel of the other. The hoisting machine 130 is typically installed at the top floor or at an intermediate floor 150 of the building and is supported there by legs 135 or a pedestal.

As shown in FIG. 1, at one side, the car side, the ropes 100 extend off the hoisting machine 130 perpendicular to the floor 150. At the other sheave side of the hoisting machine 130, the ropes 100 are guided obliquely to the floor 150 from the sheave 120, which causes the above-described offset of the elevator car 110 and the counterweight 140.

During normal operation of the elevator, the ropes 100 become coated with contaminants that adhere to the individual wires of which the body of each wire rope 100 is comprised. These contaminants include building grime, air borne dust, and rust produced by external sources of moisture. Local area safety codes typically require that the wire ropes 100 be periodically inspected, cleaned and lubricated to prevent deterioration and possible operating danger. Wire ropes have usually been cleaned by hand, using rags, cable lubricant and wire brushes. Such rope maintenance is often performed during normal elevator operation. As the wire ropes 100 may travel at speeds ranging from 500 to 1600 feet/minute, manual cleaning is dangerous.

Various types of non-manual wire rope cleaning devices are known in the art. For example, U.S. Pat. No. 5,386,882 discloses an apparatus for mechanically holding a pair of wire brushes on either side of the perpendicular path of ropes 100 in FIG. 1, hereof. FIGS. 2A and 2B hereof illustrate a U shaped holder 175 that can be bolted directly to the floor 150 in an area, corresponding to a hole 160 shown in FIG. 1. In the embodiment shown in FIGS. 2A and 2B, the holder 175 is not adjustable, and only wire brushes of a precise size work properly in the apparatus.

Another known wire brush cleaning apparatus 185 is described in U.S. Pat. No. 5,036,563 illustrated by FIGS. 3A and 3B hereof. Rotating cylindrical brushes 180 are placed on a shaft offset from the rope 100. The apparatus 185 taught by the U.S. Pat. No. 5,036,563 patent is inefficient, partially because the brushes 180 rotate at a speed comparable to the rotation speed of a drive sheave, and in the same direction of movement thereby resulting in poor performance.

U.S. Pat. No. 5,784,752 discloses a wire brush cleaning device 190 that comprises a lateral cylindrical brush 195 rotating on a center shaft within a metal enclosure 192 as illustrated in FIGS. 4A and 4B hereof. This device is believed to be inefficient for the same reason as the previously described device. This is because rotating brush 195 does not provide effective scrubbing action across the surface of a wire rope 100. An incorporated scraping bar in this device removes only desiccated deposits. Moist debris embeds deeply within the core of the brush 195 and negates the effect of the cleaning bar.

FIGS. 5A, 5B and 6 illustrate an adjustable brush cleaning apparatus 194 disclosed in U.S. Pat. No. 6,470,528. As shown in FIGS. 5A, 5B and 6, brushes 196 are mounted to a frame 198. The angle of brushes 196 can be adjusted to match the angle of ropes 100. One shortcoming of apparatus 194 is that only the angle of the brushes 196 is adjustable.

A brushless cleaning device disclosed in U.S. Pat. No. 5,791,011 uses a length of rolled material draped over the drive sheave and wire ropes. The fabric wipes the surface of the ropes as the ropes rotate with the sheave. One negative aspect is heat created by friction between the cleaning fabric and the rotating ropes. This heating is a possible cause of combustion which danger is compounded by the embedded, oil laden contaminants on the rope.

In all of the prior wire brush cleaning devices known in the prior art, the brushes are abraded, producing metal dust which may be drawn to magnetized parts of the hoist machine. Cracks in dry insulation around motor fields or direct contact with the machine armature can cause a short circuit due to the high current needed to operate the hoist machine. Additional pressure exerted by non-adjustable wire brush devices only increases dust produced during extended use.

SUMMARY OF THE INVENTION

The present invention improves upon the prior art by providing a wire rope cleaning apparatus that is adjustable, self-supporting, mountable, and utilizes an assortment of brush material and supports various brush sizes.

The cleaning device is preferably useful for elevator wire ropes. It employs wire brush and/or poly-bristle brush technology. The device is adjustable to permit constant equalization of brush tension against the rope surface and to allow the use of different brush materials.

In a preferred embodiment, the invention is an adjustable device for cleaning an elevator cable that is coupled to a hoisting machine for raising and lowering an elevator car. The device includes a first base plate having opposite ends and two longitudinal sides connecting the ends, side bars coupled to the longitudinal sides of the first base plate and aligned along an axis of the first base plate, so that a guide channel defined by and partially enclosed by the first base plate and the side bars. Further, a lateral bar is coupled to one end of the first base plate and the two side bars, and the lateral bar extends transversely of the side bars.

In the preferred embodiment, a second base plate is slidably attached to the first base plate and is arranged within the guide channel. An angle bracket is attached to one end of the second base plate which is opposite the lateral bar, and a brush assembly is coupled to the angle bracket. An adjustment device comprising a threaded stud moves the second base plate within the guide channel. The brush assembly is operable to clean the elevator cable as the elevator cable is moved by the hoisting machine.

The lateral bar of the first base plate includes an adjustment device, preferably an adjustment screw to move to the second base plate relative to the first base plate along the axis defined by the guide channel.

In another embodiment, the two side bars are attached to the second movable plate, thereby transferring the guide capability to the top of the apparatus.

All parts used in the device may be made of wood, metal, plastic or composite materials.

For example, a wire brush assembly is utilized for removal of heavy deposits, while softer poly-bristles can be employed for long term use without the negative effect of generating metal dust.

The cleaning device is preferably a complete cleaning apparatus, but may instead be incorporated with a bracketing or mounting platform.

BRIEF DESCRIPTION OF DRAWINGS

For the purpose of illustrating the invention, there is shown in the drawings a form which is presently preferred, it being understood, however, that the invention is not limited to the precise arrangements and instrumentalities shown. The features and advantages of the present invention will become apparent from the following description of the invention that refers to the accompanying drawings, in which.

DETAILED DESCRIPTION OF A PREFERRED EMBODIMENT

The present invention concerns a cleaning device, preferably useful for cleaning elevator wire ropes. The device includes a wire brush and/or a poly-bristle brush.

Figure 1:
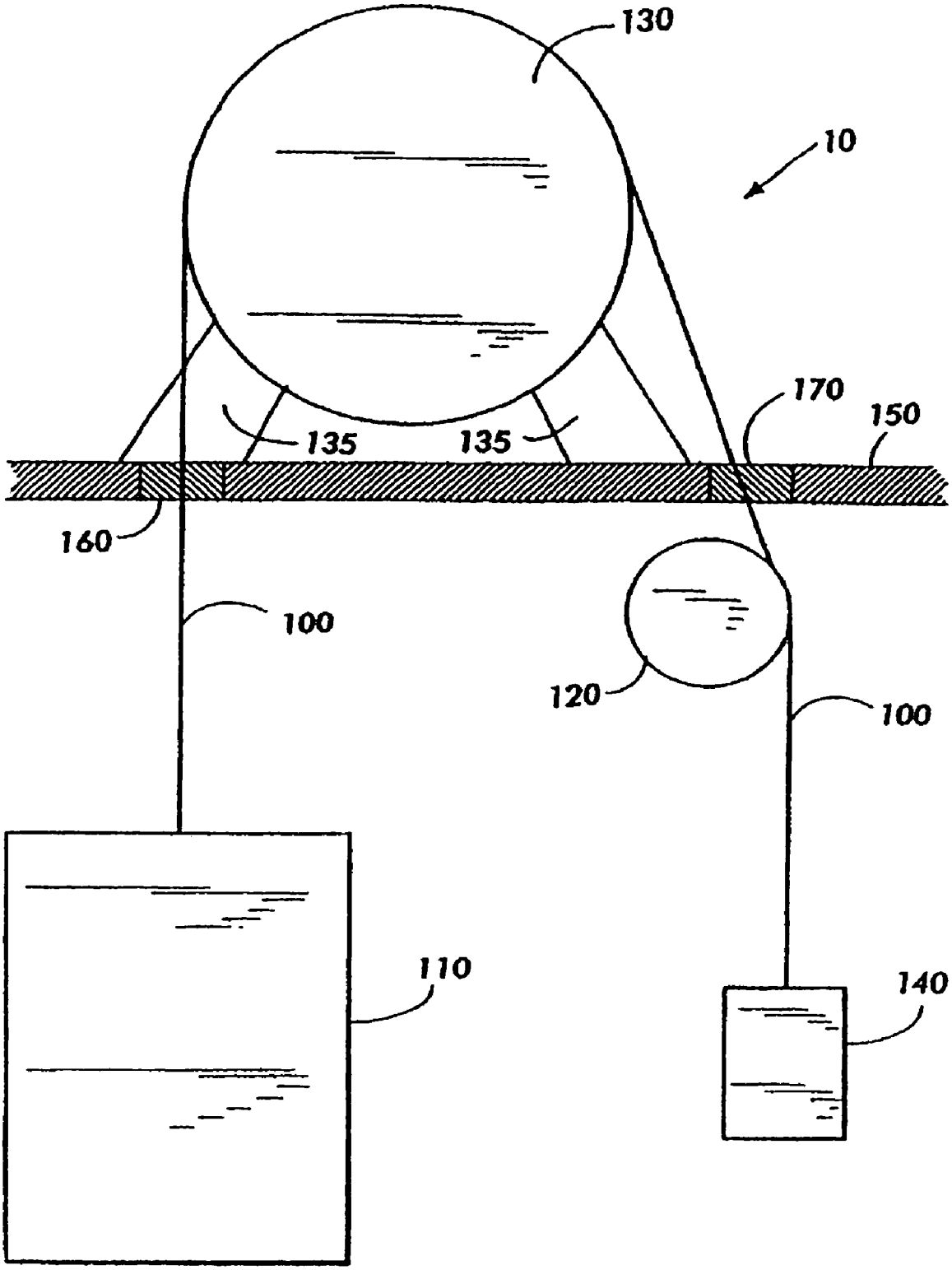
FIG. 1 PRIOR ART
FIG. 1 is illustrates a conventional elevator installation.
Figure 2A:
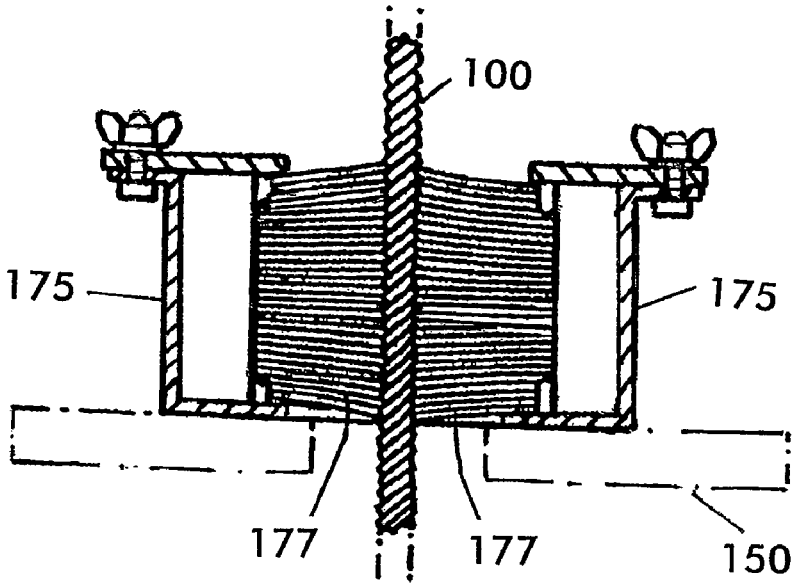
FIG. 2A PRIOR ART
FIGS. 2A and 2B illustrate a basic elevator installation described in U.S. Pat. No. 5,386,882.
Figure 2B:
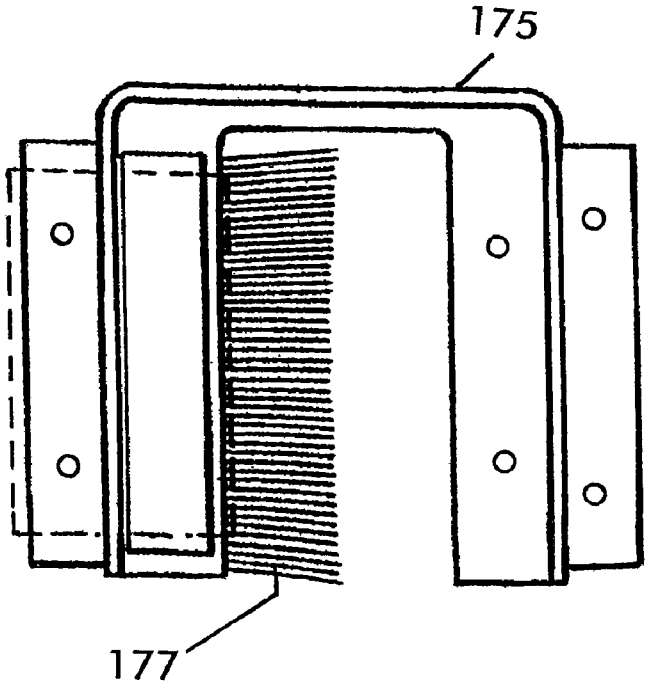
FIG. 2B PRIOR ART
Figure 3A:
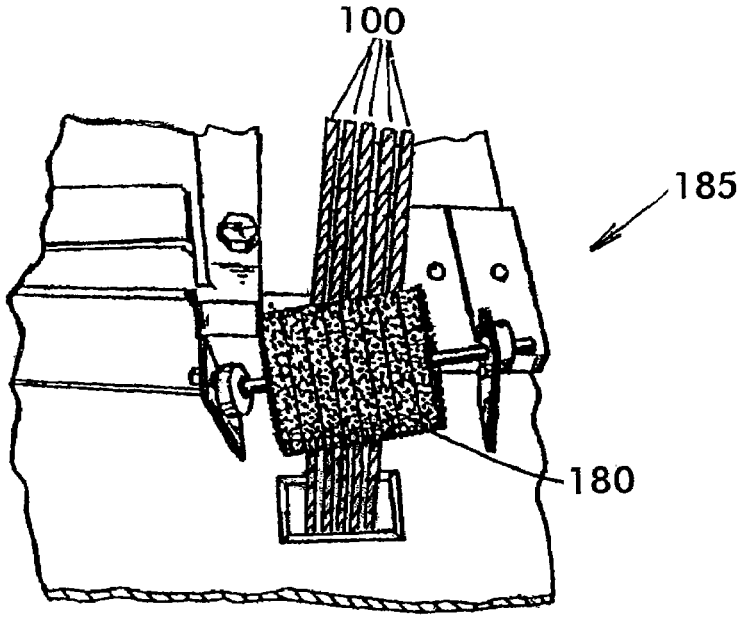
FIG. 3A PRIOR ART
FIGS. 3A and 3B illustrate a prior art cleaning device described in U.S. Pat. No. 5,036,563.
Figure 3B:
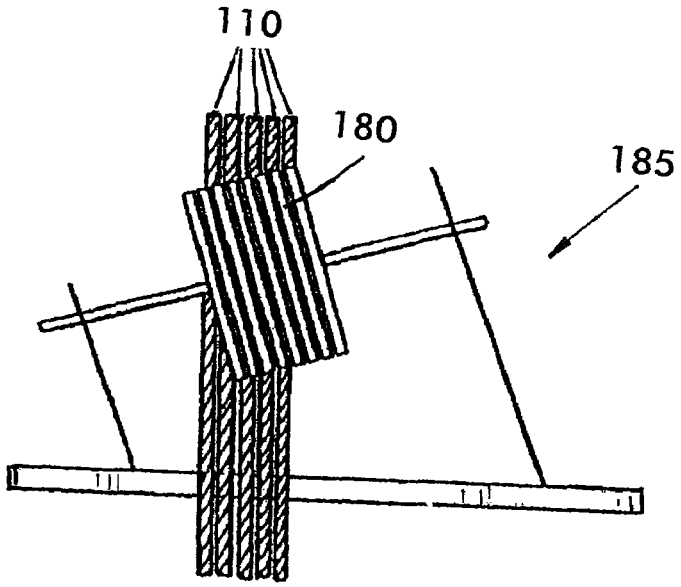
FIG. 3B PRIOR ART
Figure 4A:
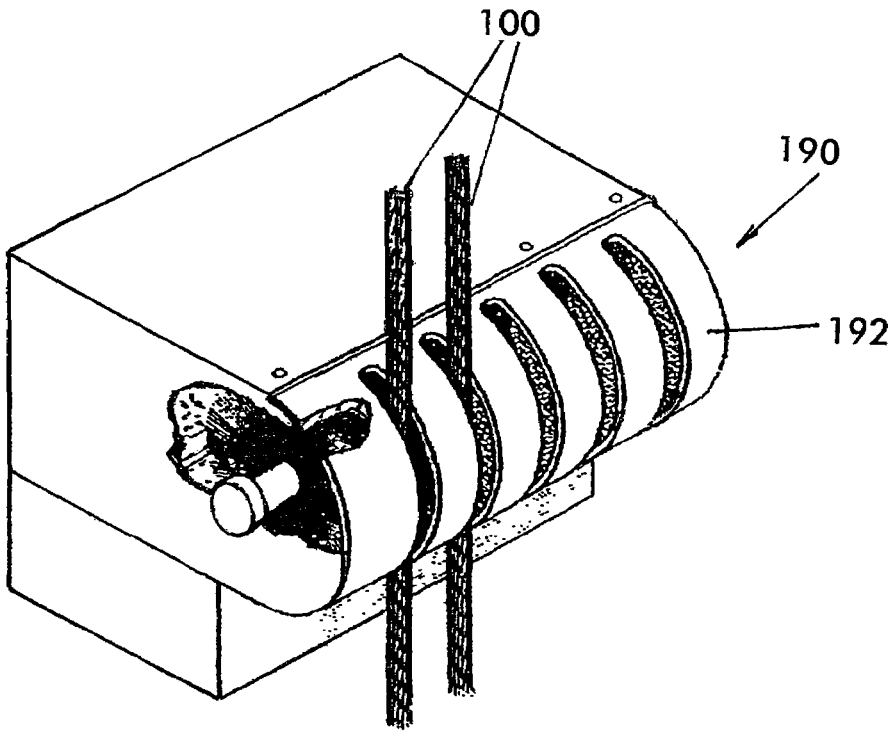
FIG. 4A PRIOR ART
FIGS. 4A and 4B illustrate a prior art cleaning device described in U.S. Pat. No. 5,784,752.
Figure 4B:
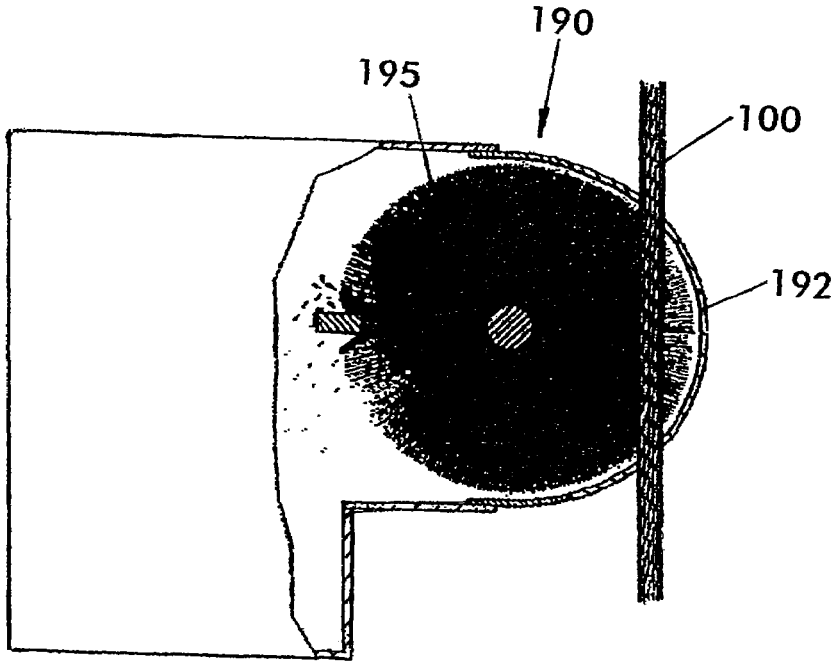
FIG. 4B PRIOR ART
Figure 5A:
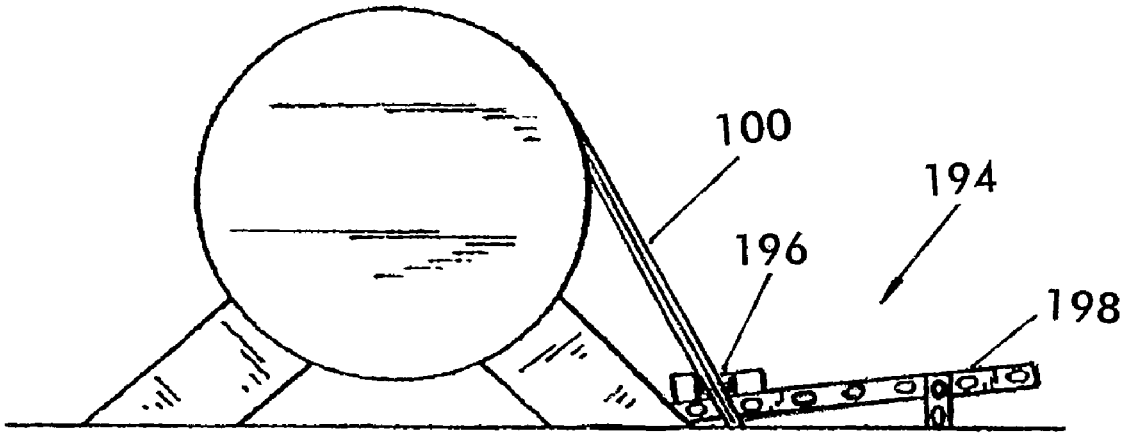
FIG. 5A PRIOR ART
FIGS. 5A and 5B illustrate a prior art cleaning device described in U.S. Pat. No. 6,470,528.
Figure 5B:
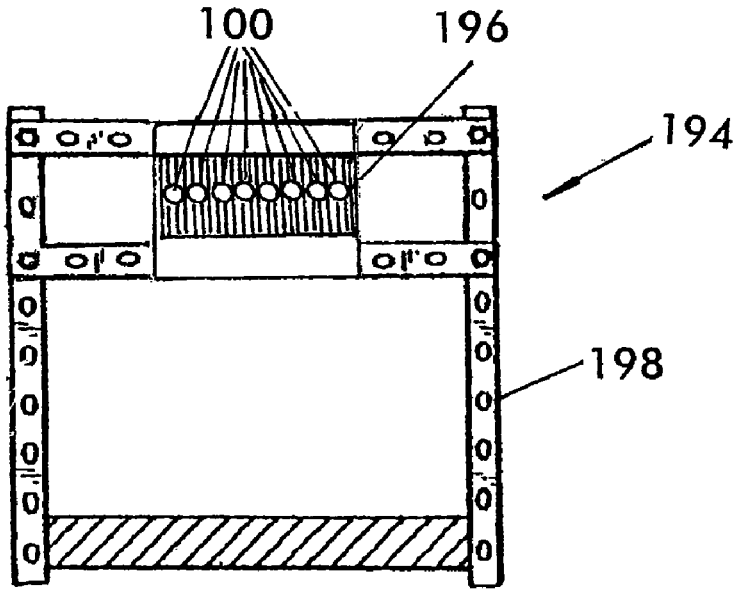
FIG. 5B PRIOR ART
Figure 6:
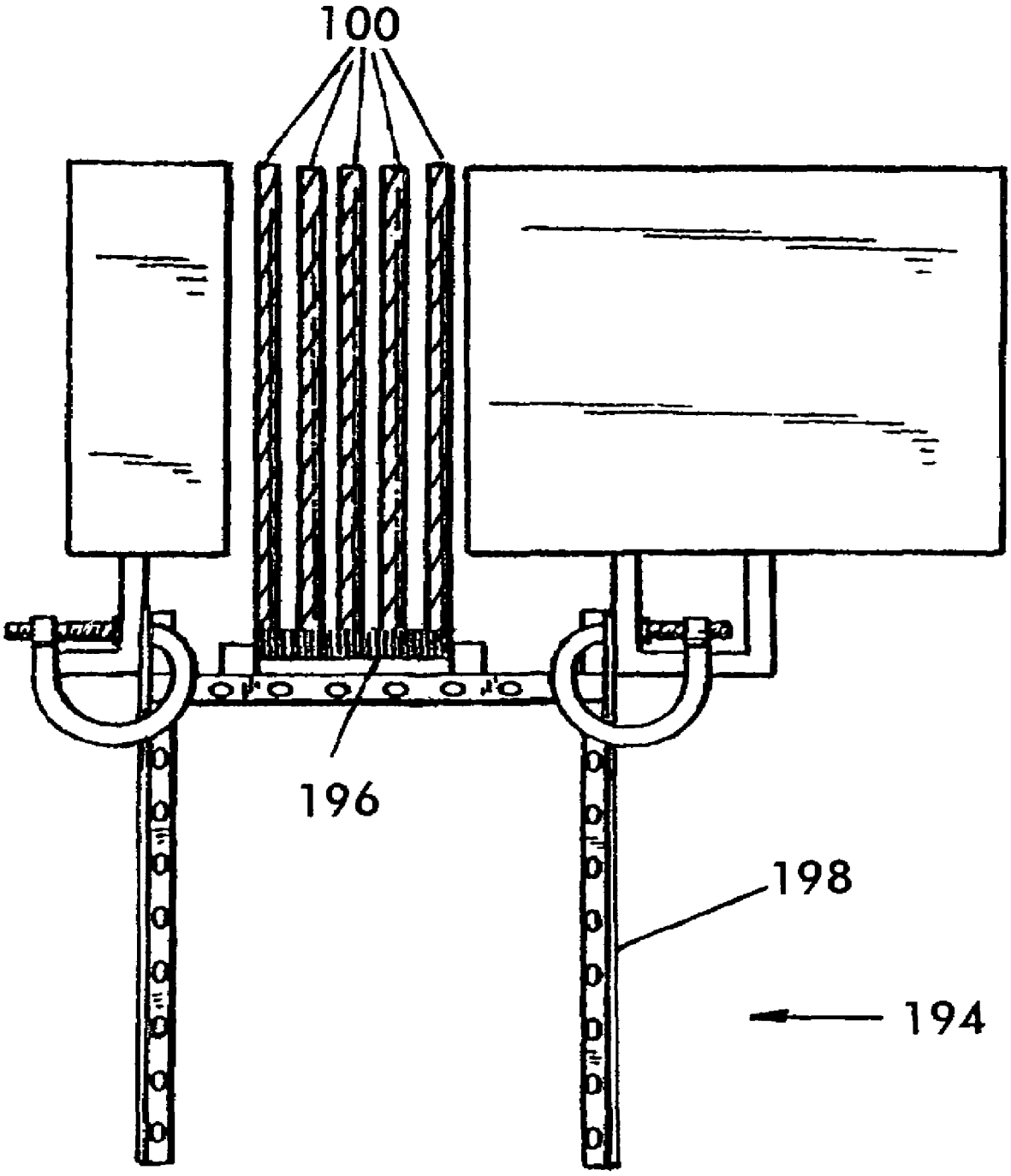
FIG. 6 PRIOR ART
FIG. 6 illustrates a prior art cleaning device described in U.S. Pat. No. 6,470,528.
Figure 7:
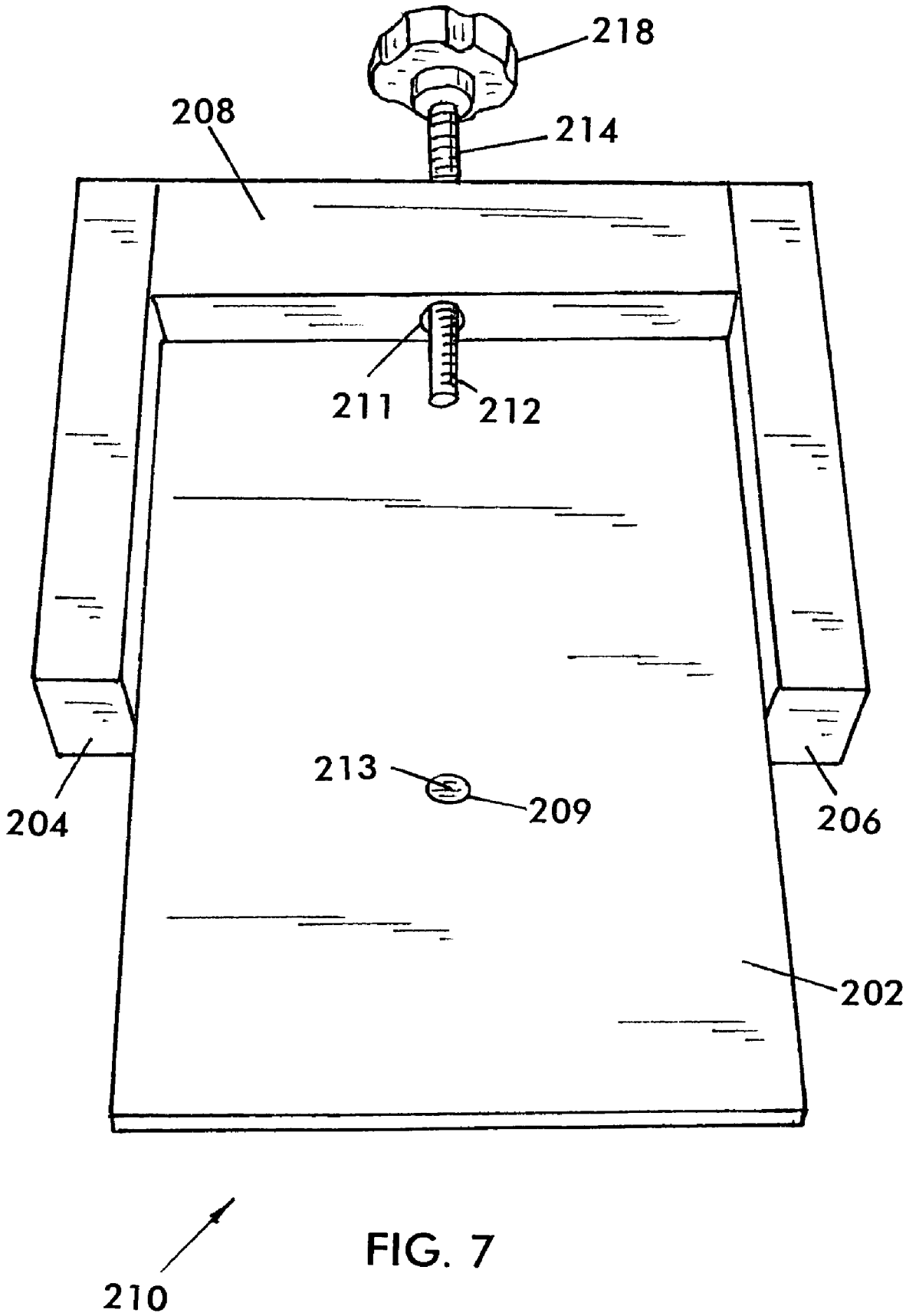
FIG. 7 illustrates a first assembly of a preferred embodiment of the present invention.

FIG. 7 illustrates a first assembly including a base plate 202, side bars 204 and 206 and lateral bar or pillar 208 at one end of plate 202. Side bars 204 and 206 attach to opposite lateral sides of the first base plate 202 and define and partially enclose a guide channel 210. In an additional embodiment (not shown), side bars 204 and 206 may be further attached to an upper plate spaced above base plate 202, further defining a closed top guide channel.

Lateral bar or pillar 208 is positioned at an end of the first base plate 202 and connects the side bars 204, 206. An aperture 211 extends across the bar 208 at its center between bars 204, 206. A threaded metal insert 212 is affixed in the aperture 211. Further, a threaded stud 214, hex nut 216 (FIG. 8) and end knob 218 are received in the threaded metal insert 212.

A vertical hole 209 extends through the first base plate and a metal insert 213 is inserted into the hole 209.

Figure 7A:
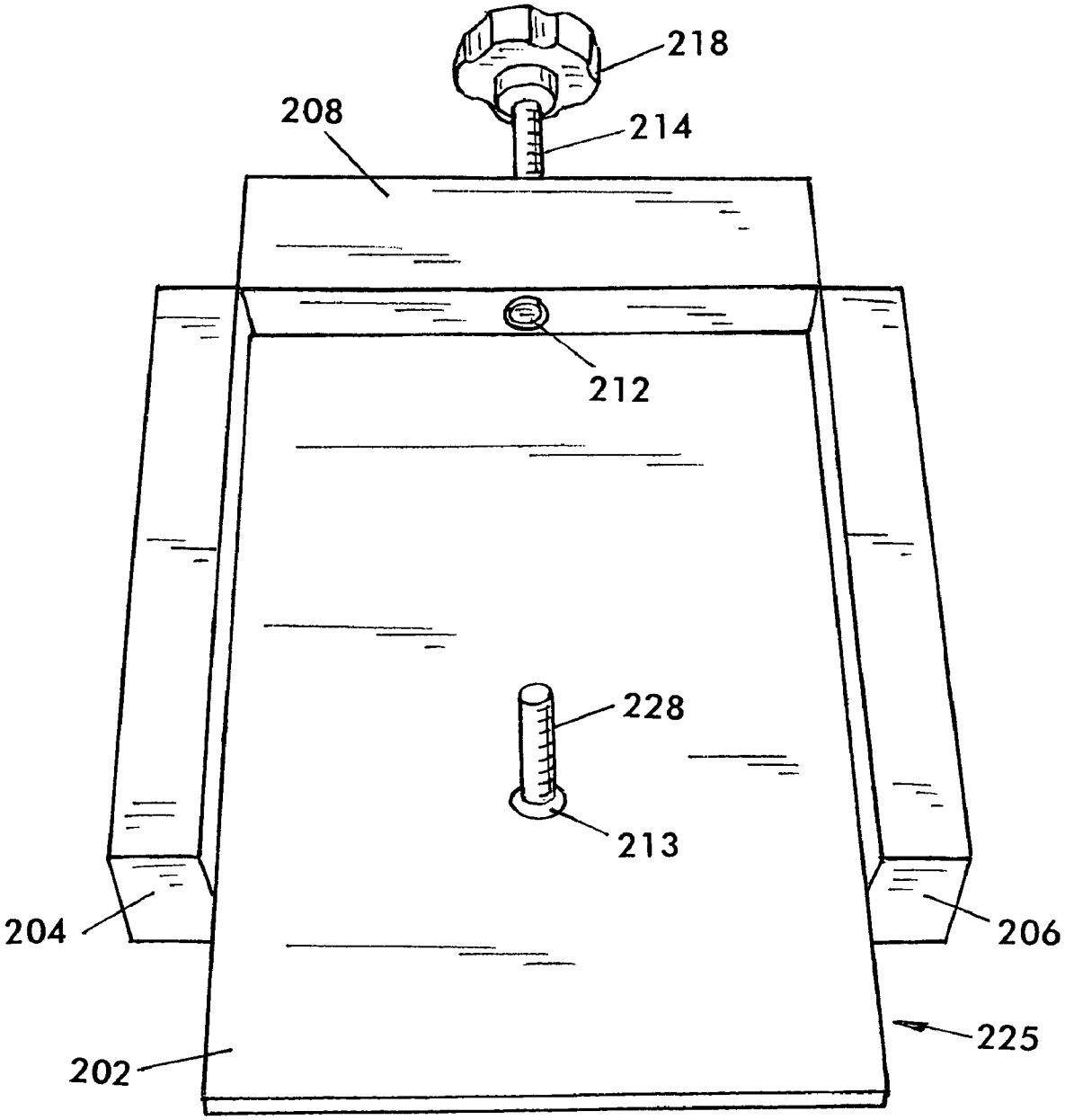
FIG. 7A illustrates a version of the first assembly including a vertical stud.

FIG. 7A illustrates a modified embodiment with a first assembly 225 including the first base plate 202 and vertical stud 228 projecting up through the plate. The vertical threaded stud 228 is preferably glued within the threaded metal insert 213 of first base plate 202.

Figure 8:
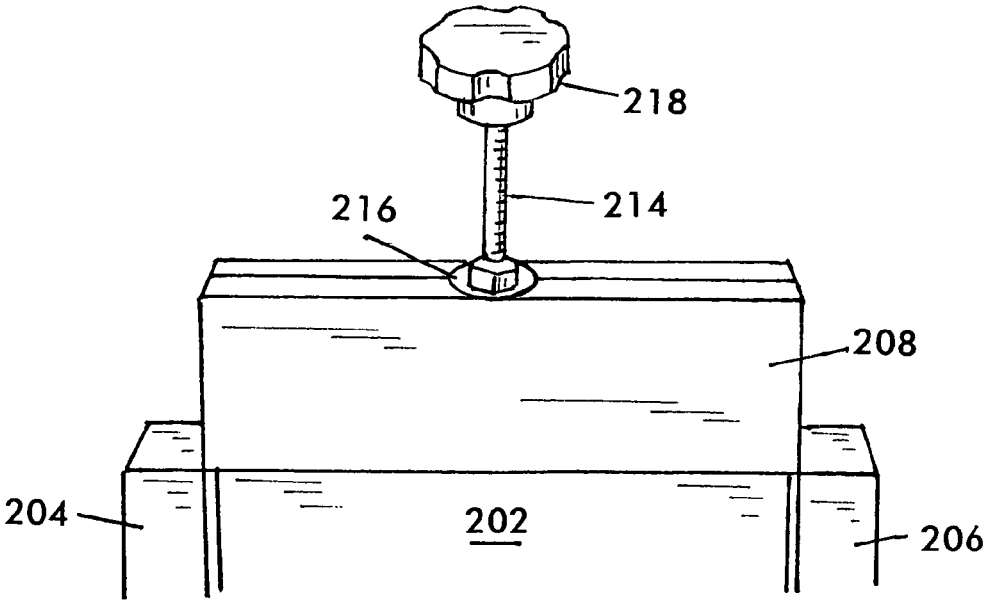
FIG. 8 shows a distal bar of the first assembly.

The FIG. 8 shows the stud 214 along with associated hardware inserted into the lateral bar or pillar 208. The horizontally oriented threaded stud 214 is operable to move through the lateral bar or pillar 208. The stud 214 is lockable at any selected inserted position by a nylon core with an attached hex nut 216.

Figure 9:
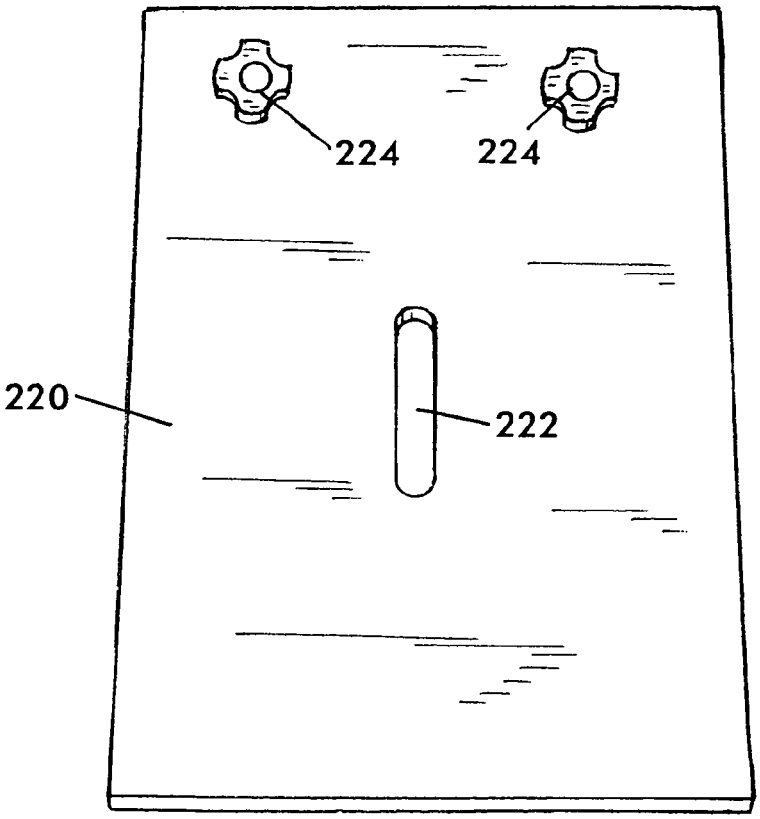
FIG. 9 illustrates a second plate of a second assembly.

FIG. 9 illustrates a second base plate 220. Slot 222 passes through the second base plate 220 near its midpoint and on the long axis. Threaded metal inserts 224 are affixed in two holes near an end of second base plate 220. During assembly of the second base plate 220 above the first base plate 202, the vertical stud 228 in the first plate aligns with and passes through the midline slot 222 in the second plate 220. As described below, the second base plate 220 is secured to the first base plate 202 by a knob 230 (FIG. 11).

Figure 10:
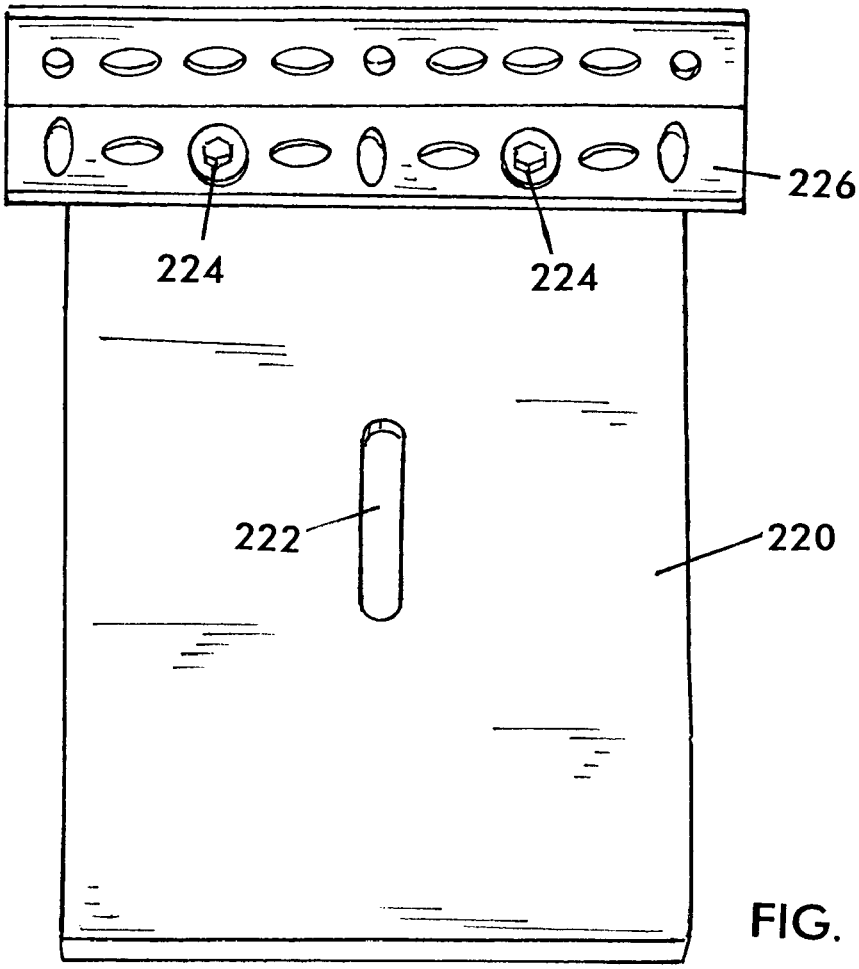
FIG. 10 illustrates the second plate with angle bracket.

FIG. 10 illustrates that an end of the second base plate 220 is coupled to a brush holder, in the form of an angle bracket 226. The bracket 226 is secured to the end of the second base plate 220 by threaded bolts threaded into the metal inserts 224 in the second base plate. The bracket may have numerous slots and holes to receive variously positioned attachment devices. As described below with reference to FIGS. 12-14, a brush assembly 236 (FIG. 12) attaches to the slotted angle bracket 226 to enable cleaning of a wire rope, for example, an elevator cable.

Figure 11:
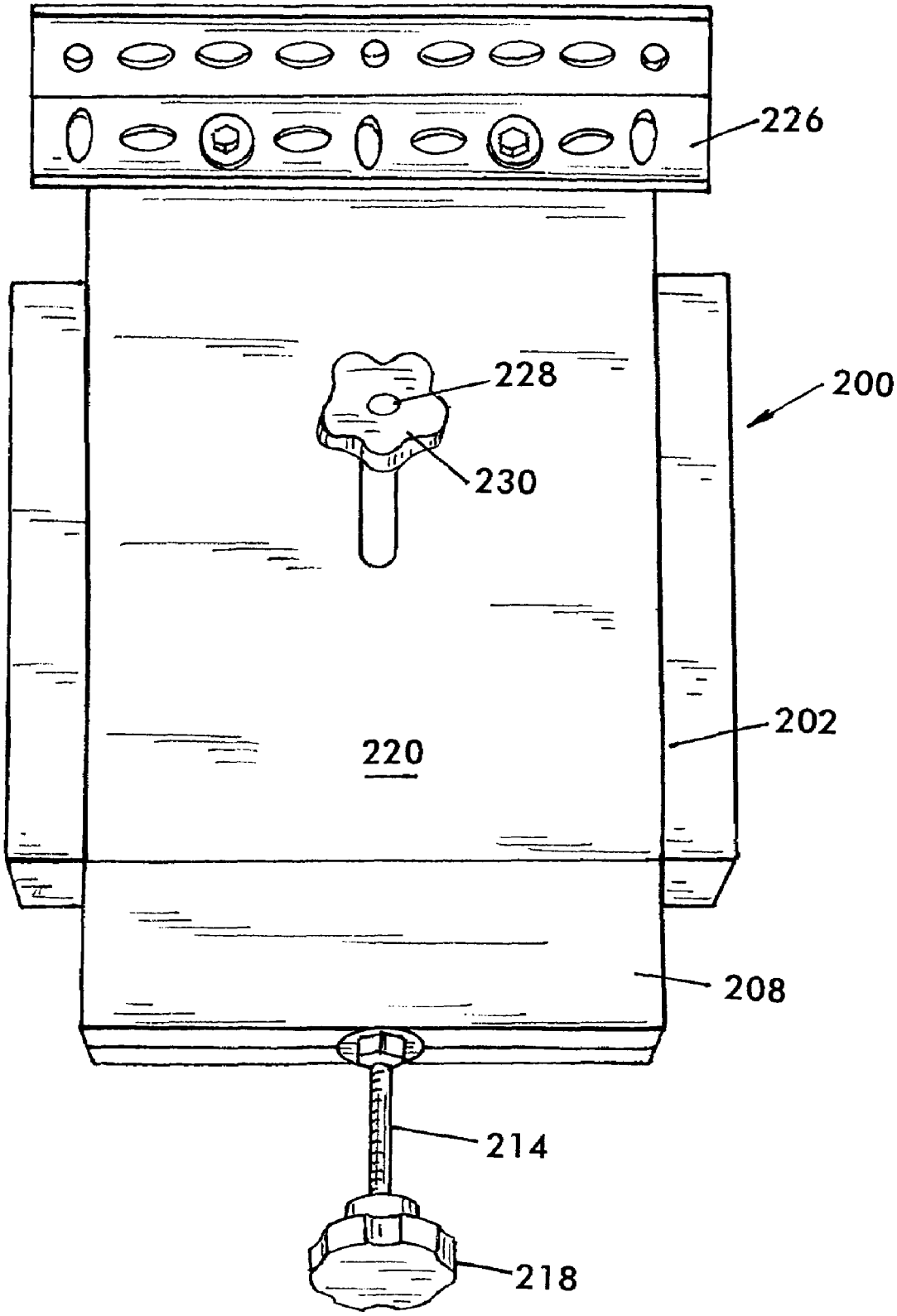
FIG. 11 illustrates an assembled apparatus with the first and second assemblies.

FIG. 11 illustrates a fully assembled apparatus 200. It includes a horizontally oriented threaded stud 214 in the lateral bar or pillar 208 at an end of the base plate 202 assembly and the stud is operated to provide selected movement of the second base plate 220 along the channel 210. A user turns knob 218 and stud 214 to move the second base plate 220.

Vertical threaded stud 228 passes through the slot 222 in second base plate 220. A locking knob 230 is positioned above the second base plate 220 and is rotated up and down along the vertical stud 228 to secure the second base plate 220 relative to the first base plate 202 at a selected location. The second base plate 220 has a controlled forward and reverse movement within the channel guide 210 on the first plate assembly. The vertical stud 228 and knob 230 anchor the second base plate 220 into a cleaning position and allow adjustment for different size or bristle length brushes and to accommodate brush wear.

Figure 12:
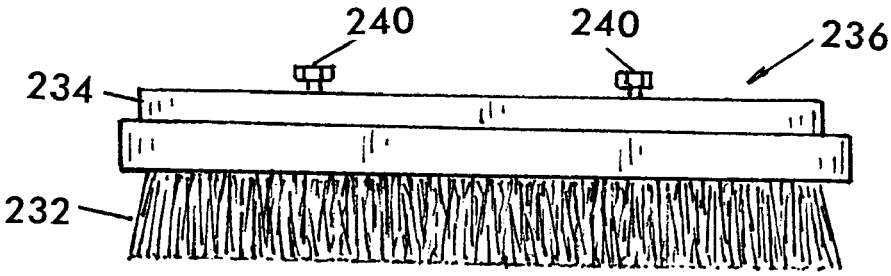
FIG. 12 shows a brush embodiment for use with the invention.
Figure 13:
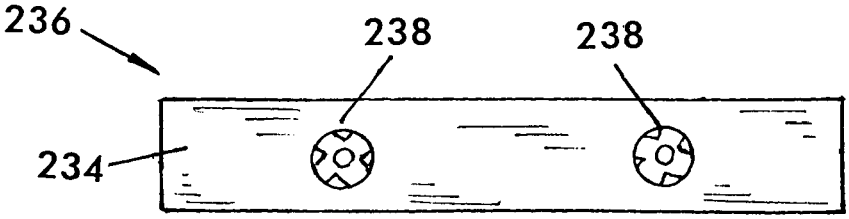
FIG. 13 shows the auxiliary backing and recessed threaded inserts of a brush assembly of the present invention.

FIGS. 12 and 13 show an embodiment of a brush assembly 236 that includes a brush 232 and backing 234. The brush 232 is preferably fabricated of metal bristles or poly-bristles that are inserted into a flat backing, preferably made of wood or plastic blocks. Backing 234 secures the brush assembly to slotted angle bracket 226 via bolts 240.

In FIG. 13, backing 234 and its recessed threaded inserts 238 are seen. The threaded inserts 238 receive bolts 240 (FIG.

12), which attach to slotted angle bracket 226. The bolts 240 are inserted through the rear side of the bracket 226 and into the metal inserts 238.

Figure 14:
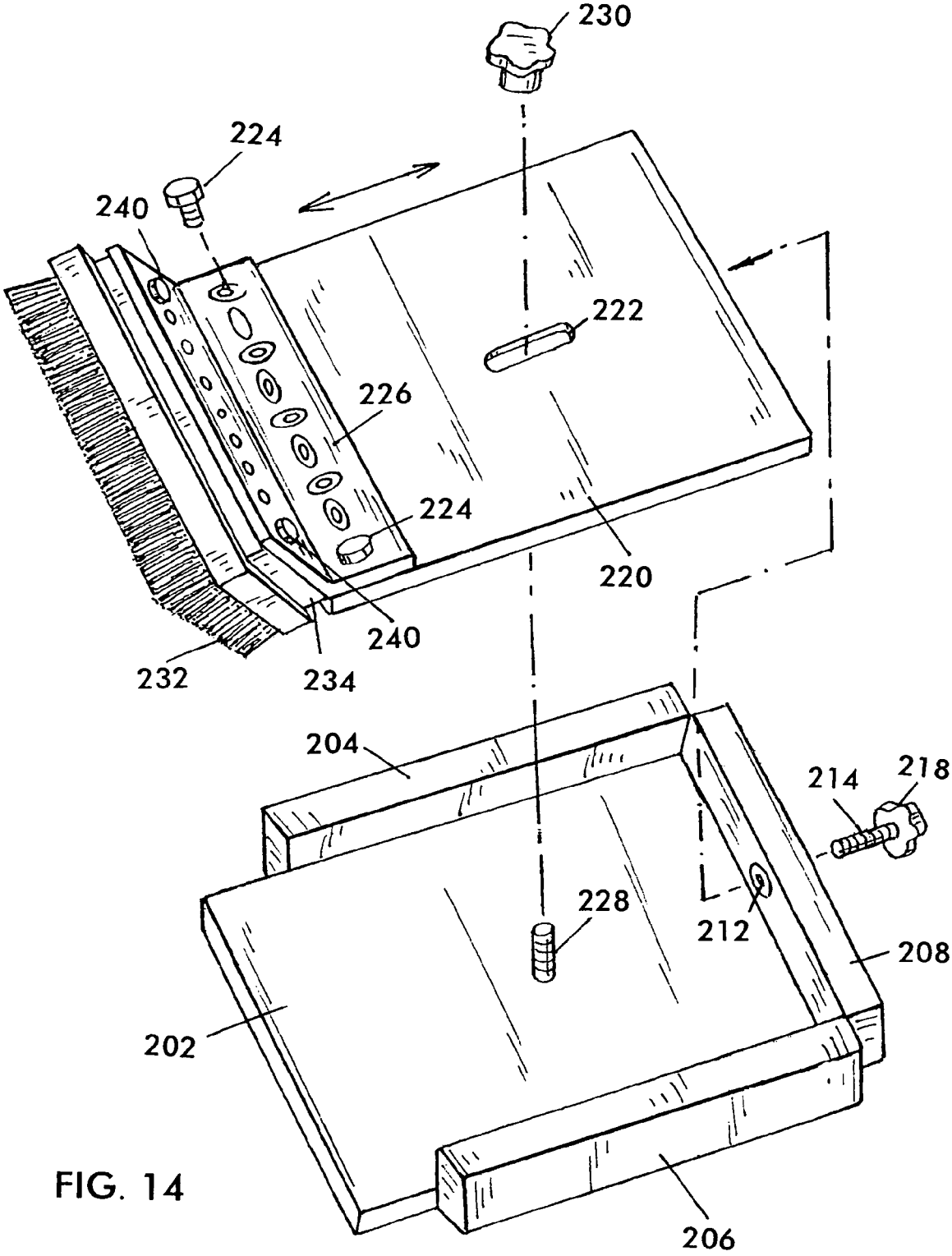
FIG. 14 is an exploded view of the apparatus in accordance with a preferred embodiment of the present invention.

FIG. 14 is an exploded view of the entire assembly described above, including the first base plate 202 and the second base plate 220 and all other elements.

In operation, rotation of the end knob 218 moves the threaded stud 214 and thereby moves the second base plate 220 to a selected position of the second base plate with respect to the first base plate. The user fixes the second base plate to the first base plate by turning knob 230. The entire assembly can be mounted to a floor or other surface.

Thus, the present invention provides a wire rope cleaning apparatus that is passive in the application of brush tension. The device is readily adjustable, self-supporting, mountable, utilizes an assortment of brush material and supports various brush sizes.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An adjustable cleaning device comprising:

a first base plate with a longitudinal axis, and a second base plate, each of the first base plate and the second base plate having a first end and a second end opposite and farthest from the first end, and two longitudinal sides parallel to the longitudinal axis;

two side bars, each side bar of the two side bars positioned at a longitudinal side of the two longitudinal sides of at least one of the first base plate and the second base plate and parallel to the longitudinal axis of the first base plate, such that a guide channel is defined and partially enclosed by the two side bars and such that the second base plate is slidably attached to the first base plate and is within the guide channel, the guide channel having a channel axis parallel to the longitudinal axis;

a lateral bar positioned at the first end of the first base plate and between the two side bars, wherein the lateral bar is positioned transverse to the two side bars;

an adjustment device positioned at the lateral bar and configured to be operable to move the second base plate relative to the first base plate along the channel axis; and a brush positioned at the second base plate, wherein a position of the brush is adjusted by the adjustment device by movement of the second base plate within the guide channel.

2. The adjustable cleaning device of claim 1, wherein the adjustment device comprises:

a threaded aperture in the lateral bar, the threaded aperture being disposed along the longitudinal axis across a width of the lateral bar and between the two side bars; and a threaded stud positioned in the aperture and rotatable to move the second base plate relative to the first base plate.

3. The adjustable cleaning device of claim 2, further comprising a threaded insert positioned in the threaded aperture in the lateral bar and the threaded stud is attached to the insert.

4. The adjustable cleaning device of claim 2, wherein the adjustment device is configured to be operable to adjust the position of the second base plate as the threaded stud is turned, thereby pressing the threaded stud against the second base plate for causing the second base plate to move within the guide channel.

5. The adjustable cleaning device of claim 4, further comprising an end knob positioned at a distal end of the threaded stud and configured to turn the threaded stud when turned.

6. The adjustable cleaning device of claim 4, further comprising a hex nut positioned and configured to secure the threaded stud to the lateral bar.

7. The adjustable cleaning device of claim 1, wherein the second base plate has a slot with a lengthwise extent along or parallel to the longitudinal axis.

8. The adjustable cleaning device of claim 7, further comprising:

a transverse threaded stud inserted in the first base plate and between the two side bars, and the threaded stud passes through the slot and is configured to secure and the hold fixed the second base plate to the first base plate; and an end knob coupled and secured to the transverse threaded stud and configured to turn the transverse threaded stud when turned.

9. The adjustable cleaning device of claim 1, further comprising a bracket attached to an end of the two opposite ends of the second base plate farthest from the lateral bar, and the brush is attached to the second base plate via the bracket.

10. The adjustable cleaning device of claim 9, further comprising a brush assembly that comprises the brush and a backing coupled to the brush, the backing positioned at the bracket to secure the brush.

11. The adjustable cleaning device of claim 10, wherein the brush assembly is secured to the bracket.

12. The adjusted cleaning device of claim 11, further comprising threaded bolts inserted through the bracket and through the brush assembly and configured to secure the brush assembly to the bracket.

13. The adjustable cleaning device of claim 9, wherein the bracket is an angle bracket comprising a first portion secured to the second base plate and a second portion secured to the brush, wherein the first portion is at an angle greater than 90° with respect to the second portion.

14. The adjustable cleaning device of claim 10, wherein the brush assembly supports any size brush of a plurality of brush sizes.

15. An elevator cable cleaning assembly configured to be secured to a building platform, the assembly comprising:

a cable coupled to the platform;

a hoisting machine configured to be operable to move the cable;

a first base plate with a longitudinal axis, and a second base plate, each of the first base plate and the second base plate having a first end and a second end opposite and farthest from the first end, and two longitudinal sides parallel to the longitudinal axis;

two side bars, each side bar of the two side bars positioned at a longitudinal side of the two longitudinal sides of at least one of the first base plate and the second base plate and parallel to the longitudinal axis of the first base plate, such that a guide channel is defined and partially enclosed by the two side bars and such that the second base plate is slidably attached to the first base plate and is within the guide channel, the guide channel having a channel axis parallel to the longitudinal axis;

a lateral bar positioned at the first end of the first base plate and between the two side bars, wherein the lateral bar is positioned transverse to the two side bars;

an adjustment device positioned at the lateral bar and configured to be operable to move the second base plate relative to the first base plate along the channel axis; and a brush positioned at the second base plate and positioned to contact and clean the cable as the hoisting machine actuates the cable, wherein a position of the brush is adjusted by the adjustment device by movement of the second base plate within the guide channel.

16. The elevator cable cleaning assembly of claim 15, further comprising a bracket attached to one end of the two opposite ends of the second base plate farthest from the lateral bar and configured to secure the brush to the second base plate.

17. The elevator cable cleaning assembly of claim 15, wherein the second base plate has a slot with a lengthwise extent along or parallel to the longitudinal axis and further comprising:

a transverse threaded stud inserted in the first base plate and between the two side bars, the threaded stud passing through the slot and configured to secure and the hold fixed the second base plate to the first base plate; and an end knob coupled and secured to the transverse threaded stud and configured to turn the transverse threaded stud when turned.

* * * * *